US012090533B2

(12) United States Patent
Kurisu et al.

(10) Patent No.: US 12,090,533 B2
(45) Date of Patent: Sep. 17, 2024

(54) METHOD FOR ROLLING STEEL SHEET AND METHOD FOR MANUFACTURING STEEL SHEET

(71) Applicant: JFE Steel Corporation, Tokyo (JP)

(72) Inventors: Ken Kurisu, Tokyo (JP); Kentaro Ishii, Tokyo (JP); Kazuma Takeuchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 596 days.

(21) Appl. No.: 17/425,467

(22) PCT Filed: Dec. 26, 2019

(86) PCT No.: PCT/JP2019/051229
§ 371 (c)(1),
(2) Date: Jul. 23, 2021

(87) PCT Pub. No.: WO2020/158284
PCT Pub. Date: Aug. 6, 2020

(65) Prior Publication Data

US 2022/0088653 A1 Mar. 24, 2022

(30) Foreign Application Priority Data

Jan. 31, 2019 (JP) ..... 2019-015726

(51) Int. Cl.
*C21D 1/28* (2006.01)
*B21B 1/28* (2006.01)
(Continued)

(52) U.S. Cl.
CPC ..... *B21B 1/28* (2013.01); *B21B 27/10* (2013.01); *C21D 8/0236* (2013.01); *C21D 9/46* (2013.01);
(Continued)

(58) Field of Classification Search
None
See application file for complete search history.

(56) References Cited

U.S. PATENT DOCUMENTS 6,042,952 A 3/2000 Aratani et al.
2016/0020006 A1* 1/2016 Watanabe ..... C22C 38/002 148/111

FOREIGN PATENT DOCUMENTS

CN 101683660 A 3/2010
EP 0138503 A2 4/1985
(Continued)

OTHER PUBLICATIONS

Chinese Office Action with Search Report for Chinese Application No. 201980090324.X, dated Oct. 10, 2022, 10 pages.
(Continued)

*Primary Examiner* — Xiaowei Su
(74) *Attorney, Agent, or Firm* — Buchanan Ingersoll & Rooney PC

(57) ABSTRACT

Provided is a method for rolling a steel sheet and a method for manufacturing a steel sheet capable of preventing occurrence of defects in appearance of a steel sheet caused by oil spots of a coolant and preventing occurrence of defects in shape of a steel sheet by appropriately controlling thermal deformation of work rolls. The method for rolling a steel sheet according to the present invention is a method for rolling a steel sheet involving feeding of a coolant to rolls that form a rolling mill during the rolling. The method includes keeping a coolant feeding rate at or lower than a predetermined rate lower than an upper constant rate at a start of operation of the rolling mill, and increasing the coolant feeding rate to the upper constant rate in response to an amount of center buckles of the steel sheet reaching or exceeding an upper target value.

6 Claims, 2 Drawing Sheets

(51) Int. Cl.

| | |
|---|---|
| ***B21B 27/10*** | (2006.01) |
| ***C21D 8/02*** | (2006.01) |
| ***C21D 9/46*** | (2006.01) |
| *B21B 1/22* | (2006.01) |

(52) U.S. Cl.
CPC ... *B21B 2001/221* (2013.01); *B21B 2027/103* (2013.01)

(56) References Cited

FOREIGN PATENT DOCUMENTS

| | | | |
|---|---|---|---|
| GB | 2051641 | A | 1/1981 |
| JP | 63230207 | A | 9/1988 |
| JP | 05669027 | A | 3/1993 |
| JP | 2000051913 | A | 2/2000 |
| JP | 2010138492 | A | 6/2010 |
| JP | 2013128958 | A | 7/2013 |

OTHER PUBLICATIONS

Extended European Search Report for European Application No. 19 913 394.3, dated Jan. 26, 2022, 6 pages.
European Communication for European Application No. 19 913 394.3, dated Apr. 11, 2023, 4 pages.
Taiwan Office Action with Search Report for Taiwan Application No. 109100411, dated Aug. 27, 2020, 7 pages.
Korean Office Action for Korean Application No. 10-2021-7023453, dated Sep. 19, 2022, with Concise Statement of Relevance of Office Action, 5 pages.
International Search Report and Written Opinion for International Application No. PCT/JP2019/051229, dated Jan. 28, 2020, 6 pages.

* cited by examiner

METHOD FOR ROLLING STEEL SHEET AND METHOD FOR MANUFACTURING STEEL SHEET

CROSS REFERENCE TO RELATED APPLICATIONS

This is the U.S. National Phase application of PCT/JP2019/051229, filed Dec. 26, 2019 which claims priority to Japanese Patent Application No. 2019-015726, filed Jan. 31, 2019, the disclosures of these applications being incorporated herein by reference in their entireties for all purposes.

FIELD OF THE INVENTION

The present invention relates to a method for rolling a steel sheet and a method for manufacturing a steel sheet, capable of preventing defects in appearance of a steel sheet resulting from an oil spot of a coolant dropping on the surface of the steel sheet during rolling, and defects in shape of a steel sheet resulting from thermal deformation of work rolls.

BACKGROUND OF THE INVENTION

The procedure of manufacturing a steel sheet involves rolling with various rolling mills. In each rolling mill, rolls that actually press steel sheets are referred to as work rolls. Some rolling mills feed a cooling fluid (hereinafter referred to as "a coolant") to rolls forming each of the rolling mills to prevent temperature rise of the work rolls due to frictional heat caused during rolling of a steel sheet. However, an inappropriate amount of a coolant would cause a failure in controlling thermal deformation of the work rolls, and cause a defect in shape of the steel sheet.

The rolling mill that feeds a coolant is typically used in secondary cold rolling performed after cold rolling and annealing. FIG. 1 illustrates a temper rolling mill 1 as a specific example of a rolling mill providing a coolant.

The temper rolling mill 1 sprays a coolant 3 on work rolls 2 during rolling to cool the work rolls 2. On the introduction side of the work rolls 2, rolling oil 6 is sprayed on the top and bottom surfaces of a steel sheet 4 to improve lubrication between the steel sheet 4 and the work rolls 2.

The coolant 3 is sprayed on the pair of upper and lower work rolls 2 through nozzles 5 disposed above and below the work rolls 2. After coming into contact with the work rolls 2, the sprayed coolant 3 is desirably drained in an atomized form. Insufficient draining of the coolant 3 may allow a liquid lump of the coolant 3 with a specific size to scatter and adhere to the top and bottom surfaces of the steel sheet 4 (such an adhering liquid lump is referred to as "an oil spot", below). The liquid lump is mixed with the rolling oil 6 fed in the previous step and dried on the surfaces of the steel sheet, and causes a spotted appearance on the surface of the steel sheet.

Patent Literature 1 is known as an example of existing technologies for preventing defects in appearance of a steel sheet caused by oil spots of rolling oil.

PATENT LITERATURE

PTL 1: Japanese Unexamined Patent Application Publication No. 05-069027

SUMMARY OF THE INVENTION

An invention described in Patent Literature 1 aims to prevent occurrence of defects in the appearance of a steel sheet by preventing oil spots of rolling oil sprayed on the upper surface of the steel sheet from the lower surface of the steel sheet. The invention described in Patent Literature 1, however, has no reference to oil spots of a coolant. As described above, defects in appearance of a steel sheet are caused by a mixture of the rolling oil and the coolant forming puddles on the surface of the steel sheet, and drying of the puddles. Although preventing oil spots of the rolling oil, the invention of Patent Literature 1 fails to prevent formation of oil spots of a coolant, and thus can still cause defects in appearance of a steel sheet.

As illustrated in FIG. 1, as an example of a known technology to improve draining of the coolant 3, a liquid drainer 7 is disposed near the nozzles 5 disposed near the upper surface of the steel sheet 4 where oil spots are more likely to occur. Even a structure including the liquid drainer 7 fails to completely prevent occurrence of oil spots of the coolant 3, particularly under operation conditions where the coolant 3 is fed at a high rate. Although not frequently, droplets of the coolant 3 sprayed from the nozzles 5 disposed below may adhere to the lower surface of the steel sheet 4 (similarly referred to as "oil spots"). A mechanism for preventing such oil spots on the lower surface of the steel sheet 4 is not known thus far.

Reducing the feeding rate of the coolant 3 to prevent oil spots of the coolant 3 impairs sufficient cooling of the work rolls 2, and fails to appropriately control deformation due to thermal expansion of the work rolls 2. Thus, simple reduction of the feeding rate of the coolant 3 would cause failure in shape of steel sheets due to failure in controlling thermal deformation of the work rolls 2.

Aspects of the present invention have been made in view of the above problems, and aim to provide a method for rolling a steel sheet and a method for manufacturing a steel sheet, capable of preventing defects in appearance of a steel sheet resulting from an oil spot of a coolant and defects in shape of a steel sheet by appropriately controlling thermal deformation of work rolls.

Aspects of the present invention are as follows.

[1] A method for rolling a steel sheet including feeding a coolant to a roll that form a rolling mill during the rolling, includes keeping a coolant feeding rate at or lower than a predetermined rate lower than an upper constant rate at a start of operating the rolling mill, and increasing the coolant feeding rate to the upper constant rate when an amount of center buckles of the steel sheet reaching or exceeding an upper target value.

[2] In the method for rolling a steel sheet according to [1], the coolant feeding rate is decreased from the upper constant rate to a lower constant rate when the amount of center buckles of the steel sheet reaching or falling below a lower target value.

[3] In the method for rolling a steel sheet according to [1] or [2], profile steepness at a center portion of the steel sheet is used as the amount of center buckles.

[4] In the method for rolling a steel sheet according to any one of [1] to [3], the rolling is a secondary cold rolling performed after an annealing.

[5] A method for manufacturing a steel sheet includes performing surface treatment after performing the rolling with the method for rolling a steel sheet described in [4].

According to aspects of the present invention, defects in appearance of a steel sheet can be prevented by resolving a coolant draining failure during rolling using a coolant, and thermal deformation of work rolls can be appropriately controlled to prevent occurrence of defects in shape of a steel sheet.

DETAILED DESCRIPTION OF EMBODIMENTS OF THE INVENTION

Figure 1:
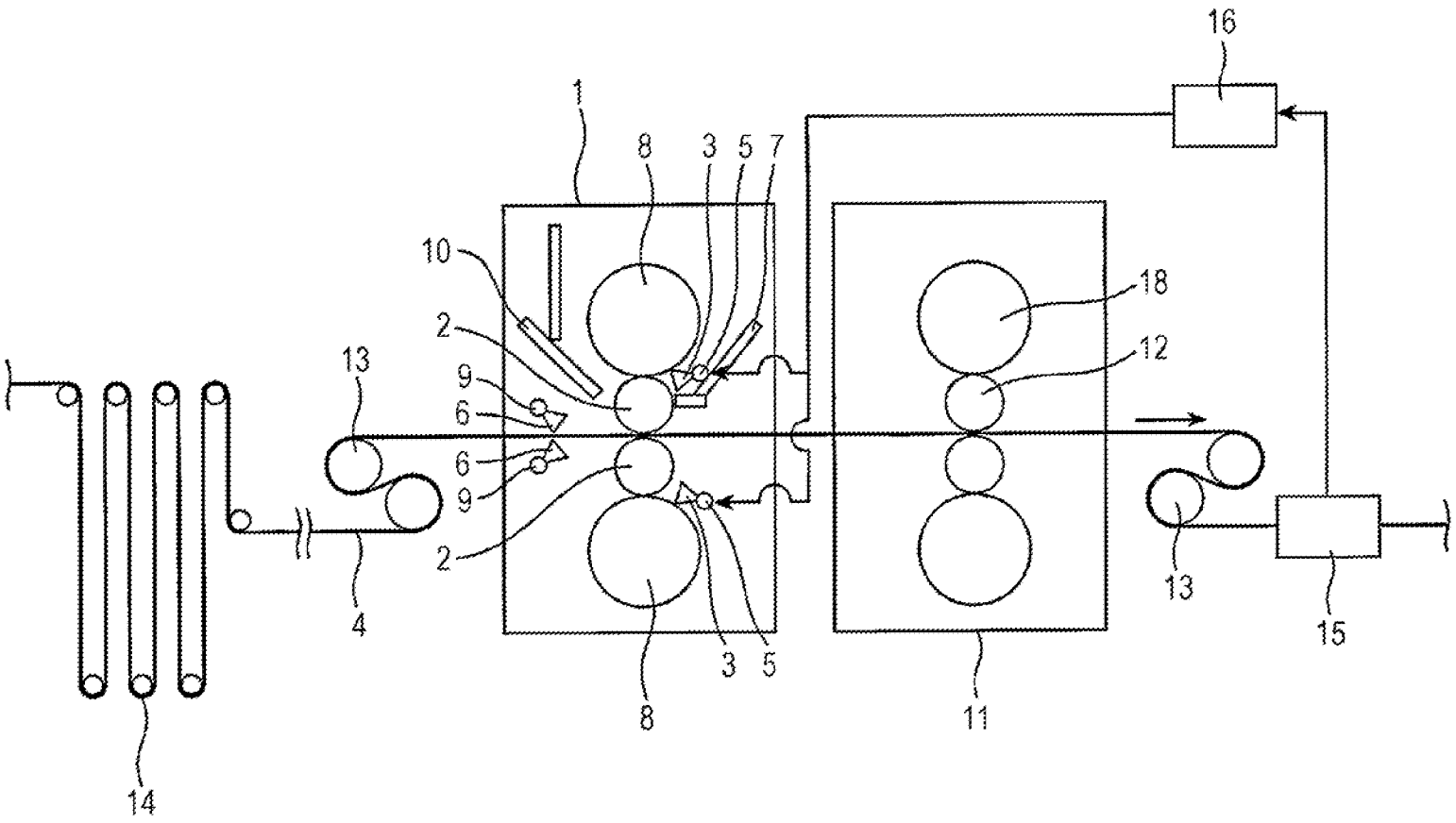
FIG. 1 is a schematic diagram of an example of a rolling mill using a coolant.

Aspects of the present invention will be described with reference to an example of a temper rolling mill illustrated in FIG. 1.

A temper rolling mill 1 includes work rolls 2 that press a steel sheet 4, and back-up rolls 8 that mechanically support the work rolls 2. To improve lubrication between the steel sheet 4 and the work rolls 2 during rolling, rolling oil 6 is sprayed on the upper and lower surfaces of a steel sheet at the introduction side of the work rolls 2. Multiple nozzles 9 that spray the rolling oil 6 may be arranged in the width direction of the steel sheet to form a group of nozzles (not illustrated). The temper rolling mill 1 illustrated in FIG. 1 by way of example is a 4-Hi rolling mill including a pair of work rolls 2 and a pair of back-up rolls 8, but the number of rolls in the rolling mill is not limited to this example. For example, examples usable as the temper rolling mill may include a 6-Hi rolling mill including, besides the pair of work rolls and a pair of back-up rolls, intermediate rolls between the work rolls and the back-up rolls, and a rolling mill including at least eight rolls.

In the rolling process, the work rolls 2 are heated by the friction between the work rolls 2 and the steel sheet 4, and between the work rolls 2 and the back-up rolls 8. A coolant 3 illustrated in FIG. 1 by way of example is sprayed on the surfaces of the work rolls 2 to cool the work rolls 2. The coolant may be sprayed on the intermediate rolls or the back-up rolls instead of the work rolls. The nozzles 5 that spray the coolant 3 may be arranged in the width direction of the steel sheet to form a group of nozzles (not illustrated). To prevent the rolling oil 6 and the coolant 3 from being mixed with each other, the group of nozzles that feed the rolling oil 6 is preferably disposed preceding the work rolls, and the group of nozzles that feed the coolant 3 is preferably disposed subsequent to the work rolls. The nozzles 5 and 9, the work rolls 2, and the back-up rolls 8 are accommodated in the same housing.

The group of nozzles disposed above the steel sheet 4 is particularly more likely to cause oil spots of the coolant 3. Thus, a liquid drainer 7 is preferably provided for the group of nozzles to improve draining of the coolant 3. The liquid drainer 7 is disposed below the group of upper nozzles that spray the coolant 3, while forming a gap with such a size as not to touch the work rolls 2 between itself and the surfaces of the work rolls 2. The liquid drainer 7 extends in the direction along the roll axes of the work rolls 2. The liquid drainer 7 is disposed while leaving a small gap between itself and the work rolls 2 to prevent a liquid lump with a relatively large diameter resulting from a draining failure of the coolant 3 from directly falling on the upper surface of the steel sheet 4.

An introduction-side scattering preventive member 10 that prevents the rolling oil 6 from scattering or falling may be disposed at an upper portion on the introduction side of the work rolls 2.

A skin-pass rolling mill 11 that fixes the surface conditions of the steel sheet may be disposed subsequent to the temper rolling mill 1. As in the case of the temper rolling mill 1, the skin pass rolling mill 11 includes work rolls 12 and back-up rolls 18, and slightly presses the steel sheet 4. Bridle rolls 13 that adjust the tension of the steel sheet 4 may be disposed preceding and subsequent to the skin-pass rolling mill 1. To perform continuous rolling, loopers 14 that adjust the sheet feeding rate are disposed preceding the temper rolling mill 1. The loopers 14 adjust the sheet feeding rate to the temper rolling mill 1 by adjusting the residence time of the steel sheet 4.

A steel-sheet measuring device 15, such as a measurement roll, is preferably disposed subsequent to the temper rolling mill 1. The steel-sheet measuring device 15 may be any device capable of measuring, for example, the conditions of the steel sheet 4 at the exit side of the temper rolling mill 1 and the sheet feeding rate in the temper rolling mill 1. More specifically, the steel-sheet measuring device 15 may be capable of measuring, for example, the widthwise tension difference caused by the difference in length of the steel sheet 4 in the rolling direction. Distribution of the widthwise tension difference can be evaluated by the size of unevenness (shape or flatness) at the center portion or edges of the steel sheet 4 with parameters such as steepness or differential expansion rate. The center portion may be a portion near the center of the steel sheet 4 in the width direction, or more specifically, an area extending from the widthwise center line to both sides in the width direction (lateral direction) within a range of 5% of the sheet width of the steel sheet 4. The edges may be portions near the ends of the steel sheet 4, or more specifically, areas extending from edges of the steel sheet 4 in the width direction within a range of 5% of the sheet width of the steel sheet 4.

Data acquired by the steel-sheet measuring device 15 is output to an arithmetic unit 16. Although the details will be described later, the arithmetic unit 16 controls the feeding rate of the coolant 3 fed from the nozzles 5 in accordance with, for example, the sheet feeding rate of the steel sheet 4 or the amount of center buckles.

Figure 2:
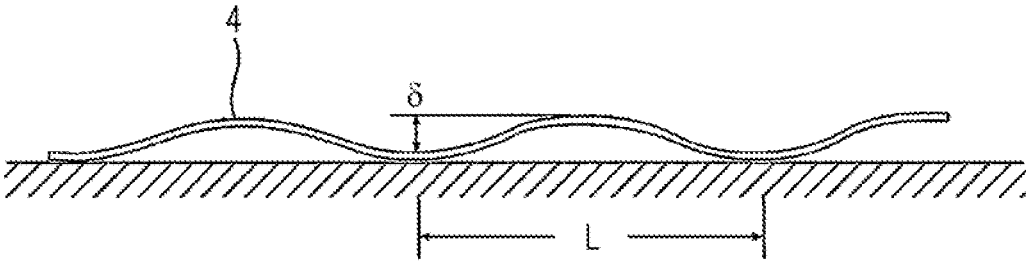
FIG. 2 is a schematic diagram of a method for measuring profile steepness.

The amount of center buckles and the amount of edge waves are calculated using the size of unevenness at the center portion or edges of the steel sheet 4 and the length thereof in the rolling direction. Examples usable as the amount of center buckles and the amount of edge waves include profile steepness at the center portion and the edges of the steel sheet 4. A method for calculating profile steepness will be specifically described with reference to FIG. 2. FIG. 2 illustrates an edge surface of the steel sheet 4, the lateral direction in the drawing corresponds to the rolling direction of the steel sheet 4, and the vertical direction in the drawing corresponds to the sheet thickness direction of the steel sheet 4. The steel sheet 4 with edge waves receives stronger rolling at the edges, and thus has a length at the edges in the rolling direction longer than the length at the center portion in the rolling direction. As illustrated in FIG. 2, the edge surface of the steel sheet 4 with edge waves has a wavy pattern. The profile steepness is calculated by dividing the undulations of waves at the edge surface with a wave span. Specifically, as shown with formula (1) below, profile steepness λ is calculated by dividing a height difference value δ in a wave cycle in the sheet thickness direction by a wavelength L. The steel sheet with larger profile steepness is more likely to have a defective shape, and the steel sheet with smaller profile steepness is less likely to have a defective shape.

$\lambda=\delta/L$ . . . (1), where λ denotes profile steepness (–), δ denotes a height difference (mm) of a wave cycle in the sheet thickness direction, and L denotes the wavelength (mm).

Although not illustrated, the profile steepness of the center buckles of the steel sheet 4 can be calculated in the same manner as formula (1). As to the center buckles, waves are formed at the center portion. The profile steepness at the center portion can be calculated by dividing the undulations of waves (specifically, height difference of the waves) at the center portion with a wave span (specifically, a wavelength).

Besides profile steepness, the amount of center buckles and the amount of edge waves may be any parameters that can evaluate the relationship between the wave height difference and the wave span at the center portion and edges of the steel sheet 4. Other examples of the amount of center buckles and the amount of edge waves include a differential expansion rate, indicating the ratio in differential expansion between the center portion and the edges, and the I-Unit, calculated by using the differential expansion rate.

Center buckles and edge waves of the steel sheet 4 are formed corresponding to thermal deformation of work rolls. Under a high temperature, work rolls are more likely to have a thermal crown shape, or a thick center portion in a sheet width direction and thin edges in the sheet width direction. When rolling is performed with work rolls with a thermal crown shape, the steel sheet is more likely to receive roll force at the center portion and less likely to receive roll force at the edges, and thus is more likely to have center buckles. Under a low temperature, on the other hand, work rolls are more likely to have a straight shape, with a small difference in thickness between the center portion and the edges in the sheet width direction. When rolling is performed with rolls with a straight shape, the steel sheet is more likely to receive roll force at the edges than when rolling is performed with rolls with a thermal crown shape, and thus is more likely to have edge waves.

Figure 3:
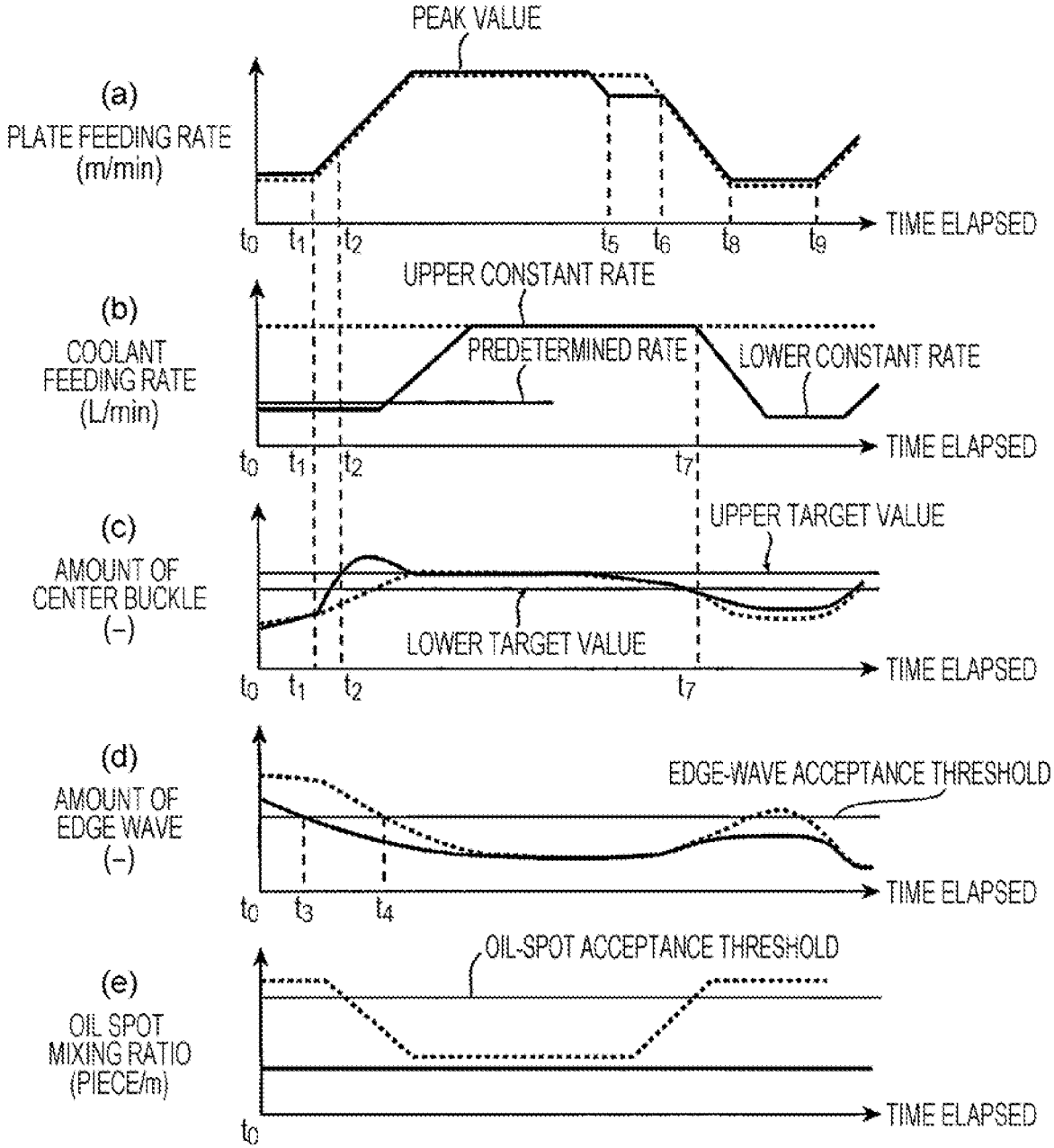
FIG. 3 includes graphs showing a sheet feeding rate, a coolant feeding rate, an amount of center buckles, an amount of edge waves, and an oil spot mixing ratio in relation to a time elapsed for a method for rolling a steel sheet according to aspects of the present invention and an existing method for rolling a steel sheet.

Referring to FIG. 3, a method for controlling the coolant feeding rate according to aspects of the present invention will be described. In FIG. 3, solid lines indicate the rates or amounts for the method according to aspects of the present invention, and dotted lines indicate the rates or amounts for an existing method.

For example, the sheet feeding rate of the line is low until a predetermined time elapses ($t_1$ in the drawing) from the start of operation ($t_0$ in the drawing) of the rolling mill as illustrated in FIG. 3(*a*). When the predetermined time elapses ($t_1$ in the drawing), the sheet feeding rate rises, but, as illustrated in FIG. 3(*c*), the amount of center buckles of the steel sheet does not reach the upper target value for a while after the sheet feeding rate starts rising. During a period from the start of operation of the rolling mill to the time when the amount of center buckles of the steel sheet rises to or exceeds the upper target value, the coolant feeding rate is kept lower than or equal to a predetermined rate. Under the conditions where the sheet feeding rate is low as in the case of immediately after the start of operation of the rolling mill, the work rolls have low centrifugal force and low capability of draining the sprayed coolant, and are more likely to cause oil spots of the coolant. In accordance with aspects of the present invention, the coolant feeding rate is kept low immediately after the start of operation of the rolling mill to prevent oil spots of the coolant. The rate of feeding the coolant from the nozzles disposed over the upper surface of the steel sheet and the rate of feeding the coolant from the nozzles disposed below the lower surface of the steel sheet are both kept low, so that oil spots that occur on the upper and lower surfaces of the steel sheet can be prevented.

The predetermined rate of coolant is smaller than an upper constant rate, which is an upper limit of the coolant feeding rate, and larger than a lower constant rate, which is a lower limit of the coolant feeding rate. The predetermined rate is preferably smaller than the upper constant rate by 10% or more. The predetermined rate of coolant is determined in consideration of operation conditions of various lines to prevent significant progress of thermal deformation of work rolls while reliably preventing oil spots of the coolant at the sheet feeding rate immediately after the start of operation of the rolling mill. More specifically, as illustrated in FIG. 3(*c*), the predetermined rate may be set so that the amount of center buckles of the steel sheet is substantially kept in equilibrium during a period from immediately after the start of operation of the rolling mill to when the sheet feeding rate rises (from $t_0$ to $t_1$ in the drawing).

Under the conditions with a low sheet feeding rate, the work rolls rotate at a lower speed. Thus, frictional heat generated on the surfaces of the work rolls is more likely to be small and the temperature on the surface of the work rolls is more likely to be low. Here, the work rolls are more likely to have a straight shape rather than a thermal crown shape. Thus, under the conditions with a low sheet feeding rate, the steel sheet is more likely to have a defective shape with the edge waves.

In an existing method as illustrated in FIG. 3(*b*), the coolant feeding rate is at the upper constant rate immediately after the activation of the rolling mill. The upper constant rate is set so that the work rolls are kept in thermal equilibrium when the sheet feeding rate is a constant rate (peak value) of the line. In the existing method, the coolant feeding rate is excessive when the sheet feeding rate is low as in the case immediately after the activation of the rolling mill, and thus a thermal crown shape is less likely to be formed. Accordingly, edge waves are caused for a long period after the activation of the rolling mill. In contrast, in accordance with aspects of the present invention, for a low sheet feeding rate, the coolant feeding rate is reduced to the predetermined rate lower than the upper constant rate to facilitate deformation of work rolls to a thermal crown shape in an early stage to thus prevent the steel sheet from continuously having a defective shape with edge waves for a long period. As illustrated in FIG. 3(*d*), with an existing method, a steel sheet with edge waves exceeding an acceptance threshold, which is determined as a defective product, is manufactured until $t_4$. In contrast, with a method according to aspects of the present invention, a steel sheet with edge waves exceeding the acceptance threshold is manufactured until $t_3$, which is earlier than $t_4$.

As the sheet feeding rate rises, the work rolls are further heated to have a thermal crown shape. The amount of center buckles of a steel sheet increases with formation of the thermal crown shape. In accordance with aspects of the present invention, when the amount of center buckles of the steel sheet reaches or exceeds a predetermined upper target value (time point $t_2$ in FIG. 3(*c*)), the thermal crown shape is determined to have fully grown, and the coolant feeding rate is increased to the upper constant rate. Thereafter, an increase of the coolant promotes cooling of the work rolls, and the amount of center buckles falls below the upper target value.

The amount of center buckles exceeding an upper limit is determined as being defective. The upper target value set in accordance with aspects of the present invention is lower than the upper limit used for determination of a defective product. The amount of center buckles is peaked immediately after the increase of the coolant feeding rate, and then switched to decrease. The upper target value may be set so that the peak is lower than the upper limit.

As described above, in accordance with aspects of the present invention, the coolant feeding rate is increased in accordance with the amount of center buckles of a steel sheet. This structure can prevent occurrence of defective products with an excessive amount of center buckles caused by a delay of supply of a coolant after the increase of the sheet feeding rate.

When the sheet feeding rate is increased to allow the amount of center buckles of the steel sheet to reach or exceed the upper target value, the rolls improve the draining capability. This structure thus prevents occurrence of oil spots even when the coolant feeding rate is increased.

When the amount of center buckles of the steel sheet reaches or exceeds the upper target value, the coolant feeding rate increases to the upper constant rate. After the coolant feeding rate reaches the upper constant rate, the coolant feeding rate is kept at the upper constant rate unless the sheet feeding rate of the line varies significantly. The upper constant rate may be any rate at which the work rolls are kept in thermal equilibrium when the sheet feeding rate of the line reaches the constant rate (peak value). When the work rolls are kept in thermal equilibrium, thermal deformation of the work rolls can be prevented, and thus further deformation of the work rolls into a thermal crown shape or a straight shape can be prevented. While the work rolls are in thermal equilibrium, the amount of center buckles and the amount of edge waves of the steel sheet are stable without large fluctuations.

In the example illustrated in FIG. 3(*a*), the sheet feeding rate of the steel sheet temporarily decreases at $t_5$. The temporary decrease of the sheet feeding rate occurs so that the sheet feeding rate matches the furnace speed of a furnace disposed preceding the rolling mill after the sheet feeding rate is kept at the peak value for a predetermined time period, and the entirety of the steel sheet accumulated at the loopers is discharged. Such speed reduction of the sheet feeding rate to match the furnace speed is not the speed reduction that decreases the amount of center buckles to or below a target value. Thus, the coolant feeding rate is kept at the upper constant rate after the speed reduction.

When the rolling mill finishes the operation while keeping the sheet feeding rate of the line at the peak value (or while keeping the sheet feeding rate at the same rate as the furnace speed of the furnace), it is sufficient to control the coolant feeding rate to rise to the upper constant rate, as described above. On the other hand, when the sheet feeding rate is decreased further from the peak value (or the furnace speed of the furnace) while the rolling mill is in operation, the coolant feeding rate is controlled to decrease. For example, when continuous rolling is performed while welding multiple coils together, the sheet feeding rate of the steel sheet decreases after elapse of predetermined time from around the peak value (time point $t_6$ in FIG. 3(*a*)). The rolling speed needs to be temporarily decreased so that, for example, the loopers at the introduction side of the rolling mill gains welding time immediately before feeding a to-be-welded portion between coils.

When the sheet feeding rate decreases as above, the work rolls are excessively cooled at the initial period of decreasing the sheet feeding rate (between $t_6$ and $t_7$ in FIG. 3), so that the work rolls are deformed into a straight shape. Thus, the amount of center buckles of the steel sheet decreases. Thereafter, when the amount of center buckles of the steel sheet reaches or falls below the lower target value (at the time point $t_7$ in FIG. 3(*c*)), the work rolls are determined to have been fully cooled and the coolant feeding rate is decreased. Decrease of the amount of center buckles is eased immediately after the decrease of the coolant feeding rate.

The amount of center buckles falling below a predetermined lower limit causes edge wave defects, and is thus determined as defective. The lower target value set in accordance with aspects of the present invention is higher than the lower limit used for the determination of defects. The lower target value is set so that the bottom peak of the amount of center buckles after the decrease of the coolant is higher than the lower limit (in other words, so as not to produce defective products having center buckles).

In accordance with aspects of the present invention, the coolant feeding rate is decreased in accordance with the decrease of the amount of center buckles. This structure can prevent the work rolls from being excessively cooled at the decrease of the sheet feeding rate, quickly having a straight shape, and causing excessive edge waves on a steel sheet. As illustrated in FIG. 3(*d*), an existing method can cause excessive edge waves that exceed an edge wave acceptance threshold concurrently with the decrease of the sheet feeding rate. In accordance with aspects of the present invention, in contrast, excessive edge waves can be avoided by decreasing the coolant feeding rate.

Thereafter, the coolant feeding rate is kept at the lower constant rate. When the sheet feeding rate is decreased by, for example, feeding to-be-welded portions, the sheet feeding rate is kept at the bottom value for a predetermined time period (between $t_8$ and $t_9$ in the drawing). When the sheet feeding rate is kept at the bottom value, the lower constant rate may be any rate at which the work rolls are kept in thermal equilibrium.

Subsequently, after the completion of, for example, feeding of to-be-welded portions, the sheet feeding rate is switched upward toward the peak value again. Also in this case, as in the above case, the coolant feeding rate may be increased to the upper constant rate when the amount of center buckles reaches or exceeds the upper target value.

The coolant feeding rate is controlled by the arithmetic unit 16 illustrated in FIG. 1. The arithmetic unit 16 acquires or calculates the sheet feeding rate and the amount of center buckles of the steel sheet 4, and controls the nozzles 5 based on these values to adjust the feeding rate of the coolant 3.

As illustrated in FIG. 3(*e*), an existing method is more likely to cause appearance defects due to the oil spots of the coolant when the sheet feeding rate is decreased, for example, immediately after the activation of the rolling mill or in response to feeding of to-be-welded portions, and thus produces a steel sheet with oil spots exceeding an oil spot acceptance threshold. On the other hand, aspects of the present invention decrease the coolant feeding rate when the sheet feeding rate is decreased, and thus can prevent production of a steel sheet with oil spots exceeding the oil spot acceptance threshold. The oil spot mixing ratio illustrated in FIG. 3(*e*) is the number of oil spots per 1 meter in the transportation direction of the steel sheet.

Examples usable as a coolant include a water solution and a mixture of a water solution and oil.

A method for rolling a steel sheet according to aspects of the present invention is particularly preferably applied to the secondary cold rolling. In cold rolling, after a hot coil is rolled by a tandem cold rolling mill, the hot coil is annealed by batch annealing or continuous annealing. The secondary cold rolling is performed on an annealed steel sheet. In the secondary cold rolling, the steel sheet is slightly pressed to, for example, adjust the surface conditions.

In the secondary cold rolling, multiple coils are continuously fed while being welded, so that the sheet feeding rate intermittently increases or decreases. A plurality of temper rolling mills may be used for different uses to perform rolling in accordance with, for example, the conditions or quality of products. In this case, each temper rolling mill needs to be activated every time the temper rolling mill is switched, and thus the sheet feeding rate is low immediately after the activation. Thus, the method for rolling a steel sheet according to aspects of the present invention is applied to the secondary cold rolling to reliably prevent defective shapes of a steel sheet and appearance defects due to the oil spots of a coolant even when the sheet feeding rate frequently increases or decreases in response to continuous feeding of multiple coils while welding the multiple coils or when the sheet feeding rate is low immediately after the activation of the rolling mill.

A steel sheet subjected to the secondary cold rolling is then subjected to surface treatment such as plating or lamination to form final products. A final product is determined as defective product when more appearance defects due to oil spots than a predetermined number per unit length is observed in a coil or when the ratio of portions of a product with an excessive amount of edge waves and an excessive amount of center buckles is larger than a predetermined ratio. Manufacturing a steel sheet with a rolling method according to aspects of the present invention enables acquirement of final products of the steel sheet at a high yield.

EXAMPLE

In an actual cold rolling line, a method for rolling a steel sheet according to aspects of the present invention was used for a temper rolling mill (structure similar to that illustrated in FIG. 1), which uses a coolant, disposed subsequent to a continuous furnace. The steel sheets to be rolled were 0.150 mm and 0.160 mm in thickness, and 900 mm in width. As an example of the present invention, the coolant feeding rate was adjusted as indicated with solid lines in FIG. 3. In contrast, in a comparative example, the coolant feeding rate was kept at the upper constant rate during rolling as indicated with dotted lines in FIG. 3. For coils (20 coils in total) acquired after the secondary cold rolling, the ratio in length of a portion of a coil having a defective shape due to center buckles or edge waves and the ratio in length of a portion of a coil having defective appearance due to oil spots were calculated.

With the example of the present invention, a steel sheet had fewer portions with defective shapes, and had a yield of 99% with no appearance defects. In contrast, with a comparative example, a steel sheet had a ratio in length of a portion determined as having appearance defects due to oil spots of 3%, a ratio in length of a portion determined as having defective shapes due to edge waves of 1%, and a yield of 96%.

REFERENCE SIGNS LIST

1 temper rolling mill
2, 12 work roll
3 coolant
4 steel sheet
5, 9 nozzle
6 rolling oil
7 liquid drainer
8, 18 back-up roll
10 introduction-side scattering preventive member
11 skin pass rolling mill
13 bridle roll
14 looper
15 steel-sheet measuring device
16 arithmetic unit

The invention claimed is:

1. A method for rolling a steel sheet including feeding a coolant to rolls that form a rolling mill during the rolling, the method comprising:

keeping a coolant feeding rate at or lower than a predetermined rate lower than an upper constant rate at a start of operation of the rolling mill; and increasing the coolant feeding rate to the upper constant rate when an amount of center buckles of the steel sheet reaching or exceeding an upper target value, wherein a profile steepness of the steel sheet at a center portion is used as the amount of center buckles, the profile steepness being calculated by dividing a height difference value in a wave cycle in a sheet thickness direction at the center portion of the steel sheet by a wavelength, and wherein the center portion is an area extending from a widthwise center line to both sides in a width direction within a range of 5% of a width of the steel sheet.

2. The method for rolling a steel sheet according to claim 1, wherein the coolant feeding rate is decreased from the upper constant rate to a lower constant rate when the amount of center buckles of the steel sheet reaching or falling below a lower target value.

3. The method for rolling a steel sheet according to claim 2, wherein the rolling is a secondary cold rolling performed after an annealing.

4. A method for manufacturing a steel sheet, comprising performing surface treatment after performing the rolling with the method for rolling a steel sheet according to claim 3.

5. The method for rolling a steel sheet according to claim 1, wherein the rolling is a secondary cold rolling performed after an annealing.

6. A method for manufacturing a steel sheet, comprising performing surface treatment after performing the rolling with the method for rolling a steel sheet according to claim 5.

* * * * *